United States Patent [19]

Imai

[11] 4,244,262

[45] Jan. 13, 1981

[54] ECHO-MACHINE EMPLOYING LOW PASS FILTERS WITH A VARIABLE CUT-OFF FREQUENCY

[75] Inventor: Atsushi Imai, Osaka, Japan

[73] Assignee: Roland Corporation, Osaka, Japan

[21] Appl. No.: 940,507

[22] Filed: Sep. 7, 1978

[30] Foreign Application Priority Data

Nov. 15, 1977 [JP] Japan ..... 52-136188

[51] Int. Cl.[3] ..... G10H 1/043; G10H 1/10

[52] U.S. Cl. ..... 84/1.24; 84/DIG. 4; 84/DIG. 26; 179/1 J; 333/165

[58] Field of Search ..... 84/1.24, 1.25, DIG. 4, 84/DIG. 26; 179/1 J; 333/165, 173

[56] References Cited

U.S. PATENT DOCUMENTS

| | | | |
|---|---|---|---|
| 3,701,059 | 10/1972 | Nyswander | 333/173 |
| 3,749,837 | 7/1973 | Doughty | 179/1 J |
| 3,833,752 | 9/1974 | Van der Kooij | 84/1.24 |
| 3,835,237 | 9/1974 | Adachi | 84/1.24 |
| 3,895,553 | 7/1975 | Kawamoto | 84/1.24 |
| 3,920,905 | 11/1975 | Sharp | 179/1 J |
| 3,992,582 | 11/1976 | Osakabe | 179/1 J |
| 4,000,676 | 1/1977 | Love | 84/1.25 |
| 4,005,268 | 1/1977 | Canell et al. | 179/1 J |
| 4,080,861 | 3/1978 | Wholahan | 84/1.24 |
| 4,093,820 | 6/1978 | Yamashita et al. | 179/1 J |
| 4,164,884 | 8/1979 | Kakehashi | 84/1.24 |

*Primary Examiner*—Stanley J. Witkowski

*Attorney, Agent, or Firm*—Wenderoth, Lind & Ponack

[57] ABSTRACT

When the frequency of an input sound signal applied to a shifting type echo-machine is close to that of the shift pulse thereof, a false signal appears at the output terminal of the echo-machine, in addition to the other type of noise signal caused by inclusion of the shift pulse component in the output of the same. The present invention is an echo-machine provided with first and second low pass filters, arranged before and after the delay element included in the echo-machine respectively, with a variable cut-off frequency which varies in accordance with the frequency of the shift pulse thereby eliminating such an erroneous signal and the shift pulse component from the output signal of the echo-machine. In its more specific aspects, the echo-machine is provided with low pass filters with a variable cut-off frequency employing an active filter containing one or more integrating circuit of which the input signal is interrupted in accordance with the frequency of a clock pulse to determine the cut-off frequency of the active filter.

9 Claims, 9 Drawing Figures

ECHO-MACHINE EMPLOYING LOW PASS FILTERS WITH A VARIABLE CUT-OFF FREQUENCY

BACKGROUND OF THE INVENTION

This invention relates to an electronic musical instrument and specifically relates to an improvement in a variable delay echo-machine which is a derivative of an echo-machine defined as a sound system designed to produce echo effects by miximg a portion of the output signal of a delay element the input signal of the same delay element and which is designed to produce more impressive and fantastic sound effects by variation of the magnitude of the delay time produced by the delay element, a major element of the aforementioned echo-machine.

Referring to FIG. 1 illustrating a block diagram of a variable delay echo-machine in the prior art, an input signal representing a sound signal received at an input signal terminal 1 is applied to a delay element 4 composed of memory elements e.g. BBDs, CCDs or transistors, through a first low pass filter 2 which is to eliminate erroneous signals to be discussed later and a mixer 3 which mixes a portion of the output signal of the delay element 4 from a signal feedback line 5 back to the input signal of the delay element 4. The shift pulses for shifting the contents of the memory elements composing the delay element 4 are produced by a shift pulse generator 6 containing a variable frequency oscillation circuit designed for varying the output frequency thereof in accordance with the shift pulse frequency regulation signals to be received at terminal 8 and are supplied to the delay element 4 through a shift pulse feed line 7. The final output of the delay element 4 is produced from an output signal terminal 10, after passing through a second low pass filter 9 which is to eliminate the shift pulse frequency components which have adverse effects discussed later.

It is well-known, in the prior art, that the aforementioned variable delay echo machine is effective to produce a type of sound effects which resembles those produced by a chorus. Further, it is also well-known, in the prior art, that a type of impressive and fantastic sound effect, more specifically the stereophonic effects giving the audience the impression as if the sound originates from a moving sound source, can be readily produced by the application to the terminal 8 of extremely low frequency signals, such as functional waves produced by extremely low frequency oscillators, arbitrary waves produced by manual operations and specific waves formed from the envelopes of sound signal waves, because each of them causes the shift pulse generator 6 to generate shift pulses with a frequency determined by the nature of the specific extremely low frequency signal.

The U.S. Pat. No. 3,895,553 discloses an invention in which the frequency of the shift pulses is varied in a variable delay echo-machine similar to that illustrated in FIG. 1 to vary the magnitude of the delay time, while the input sound signal is sampled according to a fixed sampling frequency, before being applied to a delay element composed of analog shift registers. Japanese Patent Application No. 47-73189, filed July 20, 1972 and laid open Mar. 25, 1974, which is utilized as the basis of the right of priority for aforementioned U.S. Pat. No. 3,895,553 discloses another invention in which a portion of the sound signal delayed with a variable magnitude by the delay element is mixed with the original sound signal by an electronic means. Further, it is widely known in the prior art that an active filter composed of a combination of integrating circuits and operational amplifiers works as a low pass filter with variable cut-off frequency as discussed later and that a variation of the electrical capacitance of capacitors included in the integrating circuits allows such an active filter to vary its cut-off frequency. The U.S. Pat. No. 3,701,059 discloses an invention relating to a low pass filter with a variable cut-off frequency which is capable of varying the cut-off frequency thereof in proportion to the duty ratio of a received intermittent input signal applied to the signal input terminal.

Referring to FIG. 2 illustrating the amplitude-time relations for explaining the principle accounting for the occurrence of erroneous signals in the apparatus illustrated in FIG. 1, in the event the frequency of the signal A is close to that of the shift pulse train B, an erroneous signal D shown in a dotted line could be produced at the output signal terminal 10. The process in which such an erroneous signal occurs is as follows:

(i) The input sound signal A is sampled by one of the shift pulses B at the trailing edge thereof.

(ii) The amplitude of the sound signal sampled by the above means is stored in the first stage of the memory elements included in the delay element during one cycle period of the shift pulse train.

(iii) The succeeding shift pulse shifts the stored content of the first stage to the second stage of the memory elements, samples the sound signal and stores the amplitude of the sound signal sampled by the trailing edge of the shift pulse in the first stage of the memory elements during the next cycle period of the shift pulse train.

(iv) Therefore, the amplitude stored in the first stage is represented by a staircase wave. Further, the output signal wave appearing at the output terminal 10 is represented by a staircase wave which lags by the period which is the product of the number of stages of the memory elements and the cycle period of the shift pulse train.

(v) In the event the frequency of the shift pulse train B is close to that of the sound signal A, it is difficult to sample the sound signal twice during one cycle period of the sound signal, and this causes it to be impossible to reproduce the input signal from the envelop of the staircase wave appearing at the output terminal 10.

This is a problem, because it tends to be difficult to distinguish the sound signal A from the erroneous signal D. To prevent this undesirable phenomena, it is commonly practiced in the prior art to arrange a first low pass filter 2 with a cut-off frequency which is less than half of the shift pulse frequency between the input signal terminal 1 and the mixer 3.

On the other hand, referring to FIG. 3 illustrating the amplitude-time relations for explaining the causes of inclusion of the shift pulse frequency components in the sound signal of the apparatus illustrated in FIG. 1, when an input sound signal E is shifted by a shift pulse train F, the delay element 4 produces a signal G in the form of staircase wave. This means that the output of the delay element 4 contains components of the shift pulse frequency. To prevent this type of noise components from mixing with the sound signals, it is commonly practiced in the prior art to arrange a second low pass filter 9 with a cut-off frequency which is less than a half of the shift pulse frequency between the delay element 4 and the output signal terminal 10.

However, when these two low pass filters 2 and 9 are employed for elimination of erroneous signals and shift pulse frequency components, respectively, attention must be paid to the phenomena that a variation in shift pulse frequency results in a variation in the frequency of the erroneous signals and of the shift pulse frequency components. In other words, the lowest value of the shift pulse frequency determines the lowest value of the frequency of the erroneous signals and of the shift pulse frequency components. Therefore, in order to be effective even for the case of the lowest value of the shift pulse frequency, the cut-off frequency of these two low pass filters 2 and 9 must be selected to be less one half than the lowest possible value of the shift pulse frequency to be adopted in the delay element 4.

This restrictive requirement for selection of the cut-off frequency of the two low pass filters having a low fixed cut-off frequency brings about such a big problem as to degrade the fidelity of sound signals, because the lower cut-off frequency results in a narrow pass band for the entire system particularly under the conditions that the frequency of the shift pulses turns out to be very high.

BRIEF SUMMARY OF THE INVENTION

A general object of this invention is to provide a variable delay echo-machine which is free from the problem involving with the limitation of the pass band derived from the necessity of eliminating the erroneous signals and the clock pulse components contained in the output signal and which expands the pass band of the entire system to produce musical sounds with high fidelity particularly when a high frequency the shift pulse train is applied to the delay element. This general object is attained by employment of first and second low pass filters with a variable cut-off frequency disposed at the input and output terminals of the delay element, respectively, and variation of the cut-off frequency thereof according to the frequency of the shift pulse train.

Another object of this invention is to provide a variable delay echo-machine which employs first and second low pass filters with a variable cut-off frequency, characterized by the intermittent application of an input signal thereto and capable of varying the cut-off frequency thereof approximately in proportion to the duty ratio of the intermittent input signal, in order to eliminate erroneous signals and the shift pulse frequency components which vary according to the frequency of the shift pulse train.

An additional object of this invention is to provide a low pass filter with a variable cut-off frequency which employs an active filter containing one or more integrating circuits for determining the cut-off frequency thereof in order to realize favorable attenuation characteristics, and which low pass filter is characterized by the fact that the intermittent application of the input signal to each stage of said integrating circuits allows the cut-off frequency thereof to vary in accordance with the duty ratio of the intermittent input signal.

Other objects, features and advantages will be pointed out in, or be apparent from, th specification and claims, as will obvious modifications of the embodiment shown in the drawings, in which:

DETAILED DESCRIPTION OF THE PREFERRED EMBODIMENT

Figure 1:
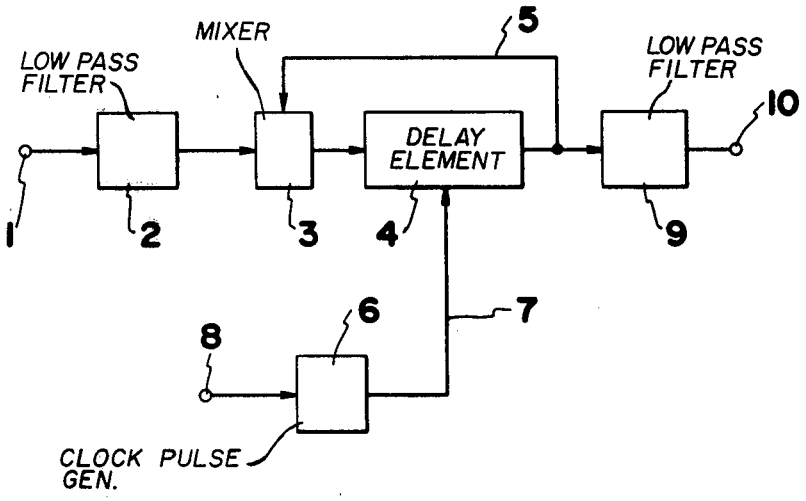
FIG. 1 PRIOR ART
FIG. 1 is a block diagram of a variable delay echo-machine, a derivative of an echo-machine, in the prior art.
Figure 3:
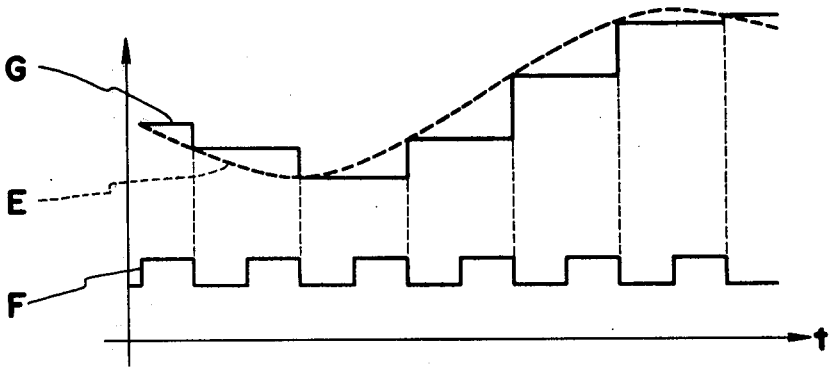
FIG. 3 is a graph showing the amplitude-time relations for explaining the causes for inclusion of the shift pulse frequency components in the sound signal in the circuit shown in FIG. 1.
Figure 2:
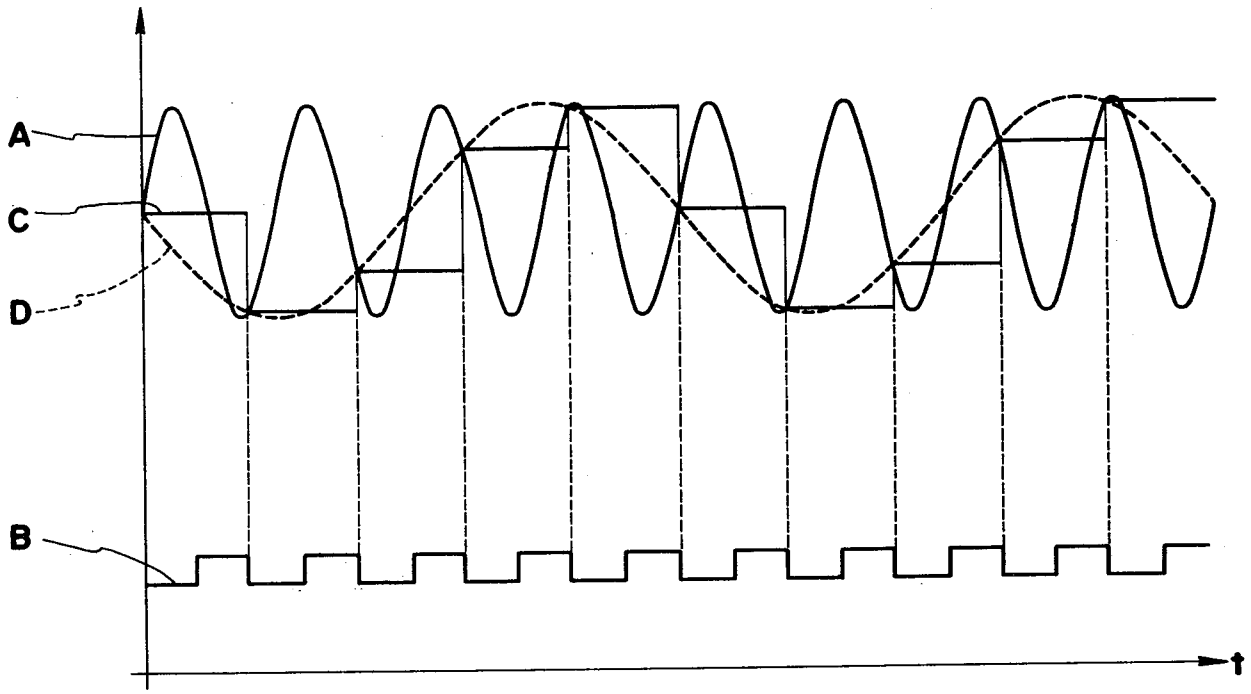
FIG. 2 is a graph showing the amplitude-time relations for explaining the principle accounting for the occurrence of erroneous signals in the block diagram illustrated in FIG. 1.
Figure 4:
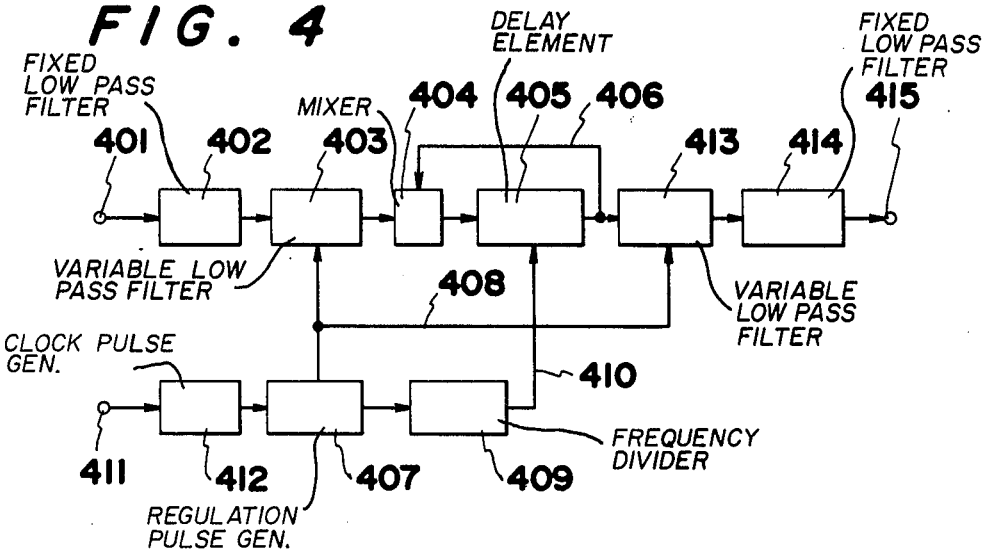
FIG. 4 is a block diagram of a variable delay echo-machine in accordance with the present invention.

The present invention, shown in FIG. 4, includes an input terminal 401, a fixed low pass filter 402 similar to low pass filter 2 of FIG. 1, a first low pass filter with a variable cut-off frequency 403 employed for elimination of erroneous signals, a mixer 404 similar to mixer 3 of FIG. 1, a delay element 405 similar to delay element 4 of FIG. 1, a signal feedback line 406 similar to signal feedback line 5 of FIG. 1, a second low pass filter with a variable cut-off frequency 413 employed for elimination of the shift pulse frequency components, a monostable multivibrator 407 for supplying the aforementioned first and second variable cut-off frequency low pass filters 403 and 413 with cut-off frequency regulation pulses via line 408, and a frequency divider 409 which is employed to satisfy two independent requirements, one is to make the frequency of the cut-off frequency regulation pulse train 40 KHz or higher in order to cover 20 KHz 3 which is the human's audible frequency band, for the entire system and the other is to make the frequency of the cut-off frequency regulation pulse train 40 KHz or higher even in cases where the frequency of the shift pulse train is the lowest, while the frequency of the shift pulse has an inherent nature to be determined in accordance with the specific purpose of the variable delay echo-machine. The output of frequency divider 409 is coupled to delay element 405 via line 410. The apparatus also includes clock pulse generator 412 which is controlled by terminal 411 similar to terminal 8 of FIG. 1.

Figure 5:
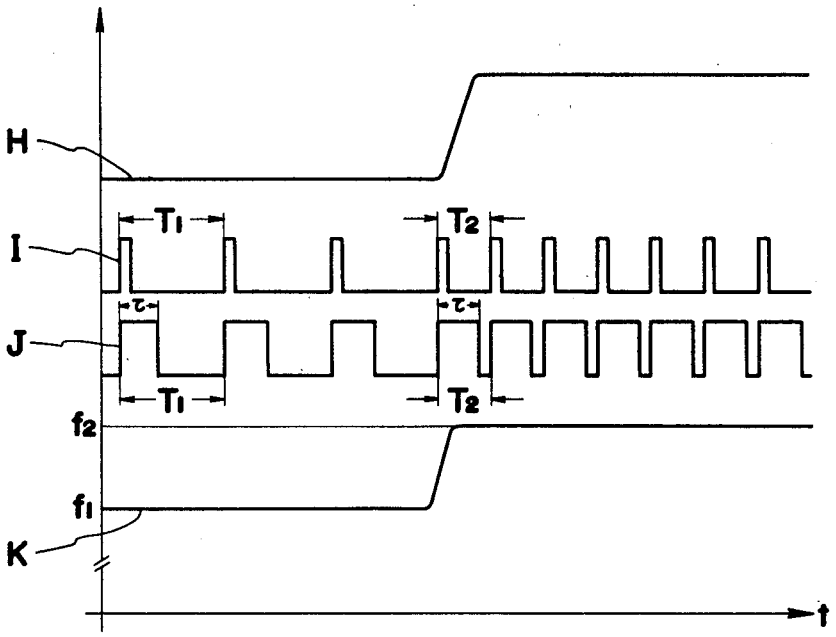
FIG. 5 is a graph showing the method by which the cut-off frequency of the low pass filters with a variable cut-off frequency is determined following the frequency regulation signal.

Referring to FIG. 4 showing a block diagram of a variable delay echo-machine in accordance with the present invention and FIG. 5 showing the manner in which the cut-off frequency of low pass filters with a variable cut-off frequency is determined following the frequency regulation signal, when a frequency regulation signal shown in H of FIG. 5 is applied to terminal 411, clock pulse generator 412 generates a clock pulse train with the frequency shown in I of FIG. 5. When triggered by application of the output signal of the clock pulse generator 412, the monostable multivibrator 407 generates a cut-off frequency regulation pulse train as shown in J of FIG. 5, and the pulse train is fed to the low pass filters with a variable cut-off frequency 403 and 413 through a line for feeding the cut-off frequency regulation pulse train 408. More specifically, when the quasistable period $\tau$ which inherently has a fixed duration in synchronism with the clock pulse generated in the clock pulse generator 412, the duty ratio of the cut-off frequency regulation pulse train $\tau/T1$ or $\tau/T2$ varies in proportion to the same clock pulse frequency. Accordingly, the low pass filters with a variable cut-off frequency 403 and 413 vary the cut-off frequency thereof, as shown in K of FIG. 5, also in proportion to the aforementioned clock pulse frequency.

Incidentally, since the cut-off frequency regulation pulse train is also applied to the frequency divider 409, the ratio of the frequency of the cut-off frequency regulation pulse to that of the shift pulse train applied to the delay element 405 through line 410 is maintained at a specific value.

Experimental results have determined that the effective variation range for the frequency of the shift pulse applied to the delay element 405 is 5–100 KHz. As described above, the cut-off frequency should be selected not to exceed 2.5 KHz for the first low pass filter with a variable cut-off frequency 403, if the shift frequency is 5 KHz. However, since an erroneous signal may be produced in the first low pass filter with variable cut-off due to the same process as is in the case of the delay element 405, the low pass filter 402 must stay in the circuit to eliminate the erroneous signals generated in the low pass filter 403, and it is evident that the cut-off frequency of filter 402 must be selected not to be exceed ½ of the frequency of the cut-off frequency regulation pulse train applied to the low pass filter 403. However, since the cut-off frequency is not variable for the fixed low pass filter 402, the pass band of the entire system depends on the cut-off frequency of this filter 402. Accordingly, it is preferable to select the cut-off frequency of the filter 402 at a value close to 20 KHz.

This requires that the frequency of the cut-off frequency regulation pulse train applied to the first low pass filter with a variable cut-off frequency 403 must equal or exceed 40 KHz, even in cases where the frequency of the shift pulse train applied to the delay element 405 is at the lowest value or 5 KHz. Otherwise, the erroneous signals produced in the first low pass filter with a variable cut-off frequency 403 are not eliminated. For this reason, the frequency dividing ratio of the frequency divider 409 is selected to be ⅛. This part of the description is also applicable to the mutual relations between the second low pass filter with a fixed cut-off frequency 414 and the second low pass filter with a variable cut-off frequency 413 both of which are employed to eliminate the shift pulse frequency components.

Figure 6:
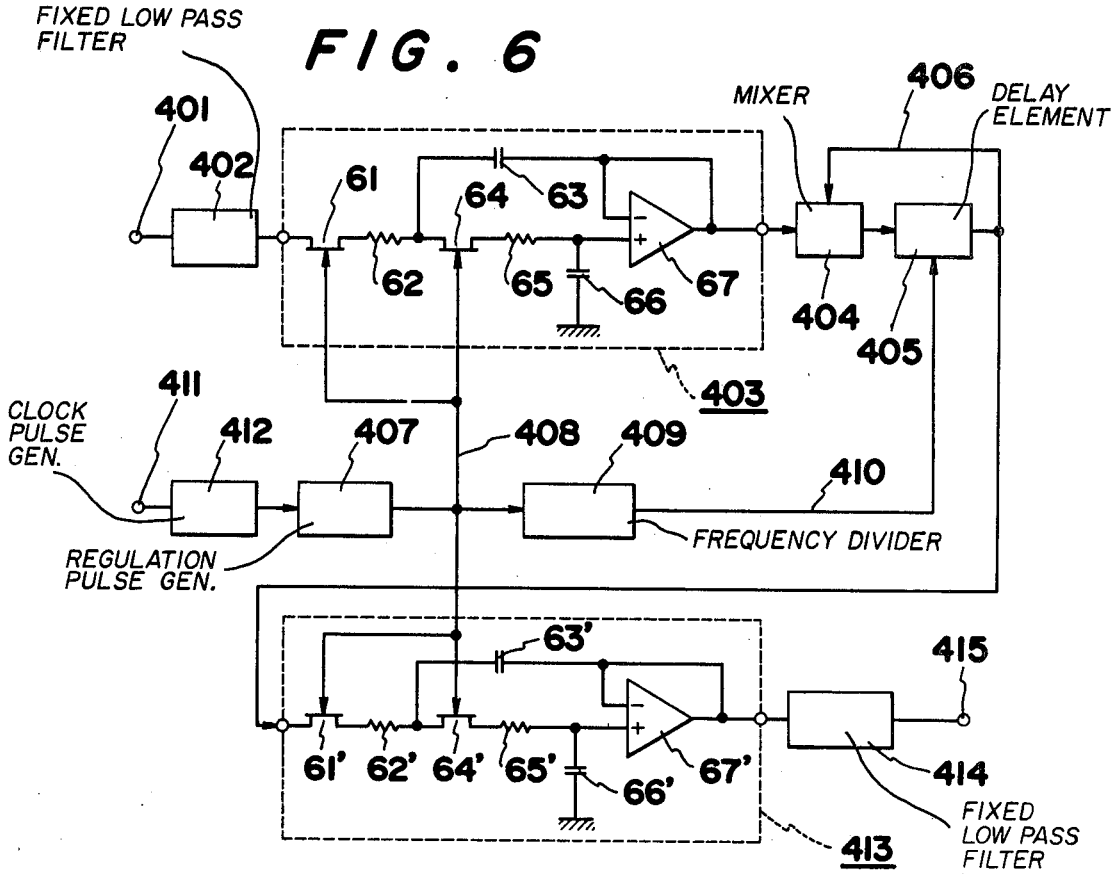
FIG. 6 is a block diagram of a variable delay echo-machine in accordance with the present invention showing the detailed arrangement of the first and second low pass filters with a variable cut-off frequency.

FIG. 6 is the same block diagram as FIG. 4 except that the low pass filters with a variable cut-off frequency 403 and 413 are shown in detail. The first low pass filter with a variable cut-off frequency 403 consists of an analog switch employing an FET 61 which is arranged at the input terminal of a first integrating circuit composed of a resistor 62 and an electostatic capacitor 63, an analog switch employing an FET 64 which is connected between the node of the resister 62 with the electrostatic capacitor 63 and a second integrating circuit which is composed of a resistor 65 and an electrostatic capacitor 66, and an operational amplifier 67 having an output of the second integrating circuit fed to the noninverting input terminal and having the inverting input terminal connected to the electrostatic capacitor 63 of the first integrating circuit, with the inverting input terminal also directly connected to the output terminal of the operational amplifier 67 which works as a voltage follower. The second low pass filter with a variable cut-off frequency 413 has the same construction as the first low pass filter with a variable cut-off frequency 403, each component of the former having a corresponding primed number.

Referring to FIG. 6, during the period in which the analog switches 61 and 64 are kept closed, the resisters 62 and 65, the electrostatic capacitors 63 and 66 and the operational amplifier 67 form, in combination, a typical Sallen-Key's Circuit type low pass active filter, having an electric characteristic which is widely known as the Butterworth Characteristic. The cut-off frequency of an active filter with this construction varies in proportion to the duty ratio of an intermittent operation performed by the analog switches 61 and 64.

Figure 7:
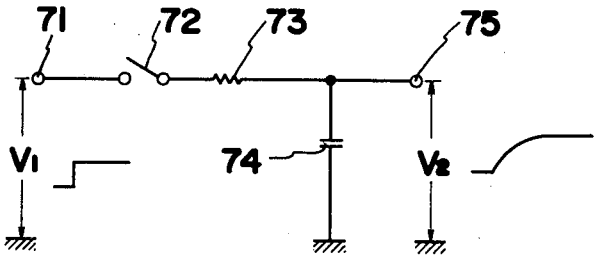
FIG. 7 is a block diagram of a simple integrating circuit.
Figure 8:
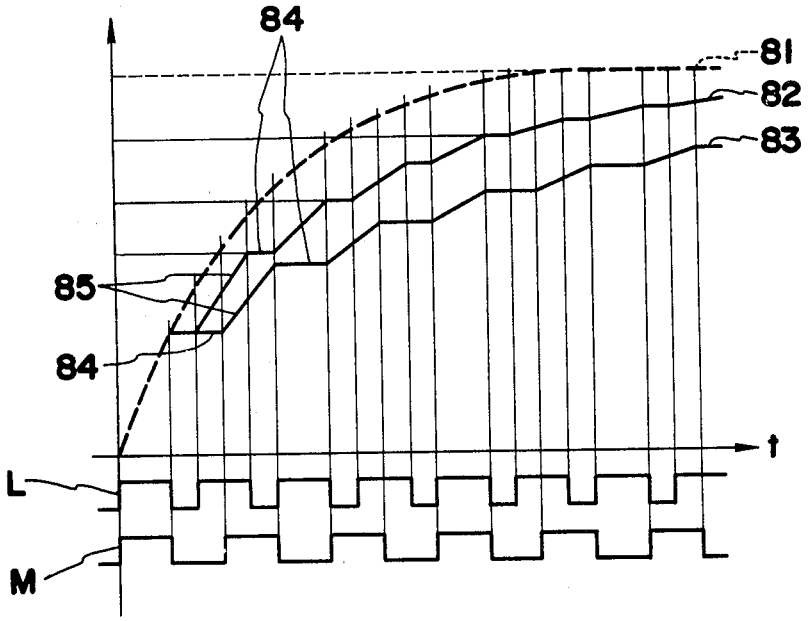
FIG. 8 is the graph showing a variation in the indicial response voltage curve caused by intermittent application of the input signal to an integrating circuit in the arrangement shown in FIG. 7.

The basic principle accounting for the aforementioned behavior of an active filter is explained below, referring to FIG. 7 illustrating a simple integrating circuit and FIG. 8 showing the variation of an indicial response voltage curve caused by the intermittent application of the input signal to an integrating ciruit with the construction shown in FIG. 7. The simple integrating circuit consists of a switch 72, a resistor 73 and an electrostatic capacitor 74, arranged between an input terminal 71 and an output terminal 75. These components correspond to the analog switch 64, the resister 65 and the electrostatic capacitor 66 in FIG. 6 in this order. When a step function voltage $V_1$ is applied to the input terminal 71 by means of the switch 72, an indicial response voltage $V_2$ appears at the output terminal 75 and increases following an exponential curve as shown by a dotted line 81. In other words, during the period in which the switch 72 is kept closed, while step function voltage $V_1$ is applied to the terminal 71, the voltage of the terminal 75 which is defined as an indicial response voltage keeps rising following an exponential curve. This is shown in FIG. 8 as a dotted line 81. However, when the switch 72 repeats the closing-and-opening operations, the situation is different. In other words, if the switch 72 is kept closed during a period of $\Delta t$ (a contact period) and kept opened during a period of $\Delta t'$ (an opening period) out of one unit period $(\Delta t+\Delta t')$, the indicial response voltage will suspend its rising tendency during the period of $\Delta t'$, regaining this rising tendency only during the period of $\Delta t$. This is because the terminal voltage of the electrostatic capacitor 74 is not increased during the period of $\Delta t'$. As a result, the resultant indicial response voltage curve is revised to a zig-zag curve consisting of flat portions 84 and inclined portions 85 from a smooth exponential curve. This tendency is illustrated in FIG. 8. Namely, if the input to the resistor 73 is interrupted by means of the switch 72 with the duty ratios shown in L and M of FIG. 8, the corresponding indicial response voltage curves respectively turn out to be as shown in solid lines 82 and 83.

The voltage-time relation is shown in the formula for the simple integrating circuit illustrated in FIG. 7:

$$V_2 = (1 - e^{-\frac{t}{RC}})V_1$$

wherein:

R is the resistance of the resistor 73,

C is the electrostatic capacitance of the electrostatic capacitor 74, t is the period of time after the step function voltage $V_1$ is applied.

As explained in the above, the length of time $\Delta t + \Delta t'$ is one unit period of the closing-and-opening-operation which the switch 72 repeats. Therefore, the reciprocal of this period, $\Delta t + \Delta t'$ is assumed to be the frequency of such closing-and-opening-operations, and is defined as f in this specification. It is possible to represent the cumulative period of time in which the switch 72 is kept closed per unit time e.g. sec. during the closing- and opening-operation by $\Delta t \times f$. Therefore, the indicial response voltage curve shown in either the solid line 82 or the solid line 83 can be approximately formulated as shown below:

$$V_2 = (1 - e^{-\frac{\Delta t \times f}{RC} \cdot t})V_1$$

If $\Delta t$ is kept constant, the time constant of this exponential function is determined in inverse proportion to f.

This theory is also applicable to determination of the time constant of integrating circuits contained in the active filter shown in FIG. 6. In other words, when the analog switch 61 interrupts the input signal of the integrating circuit consisting of the resistor 62 and the electrostatic capacitor 63, the time constant of the integrating circuit is determined in inverse proportion to the duty ratio of the analog switch 61 or the clock pulse frequency. In a similar way, when the analog switch 64 interrupts the input signal of the integrating circuit consisting of the resistor 65 and the electrostatic capacitor 66, the time constant of the integrating circuit is determined in inverse proportion to the duty ratio of the analogous switch 64 or the clock frequency generated in the clock pulse generator 412. Accordingly, it is possible to determine the cut-off frequency of the low pass filters with a variable cut-off frequency 403 and 413 in proportion to the clock pulse frequency.

Figure 9:
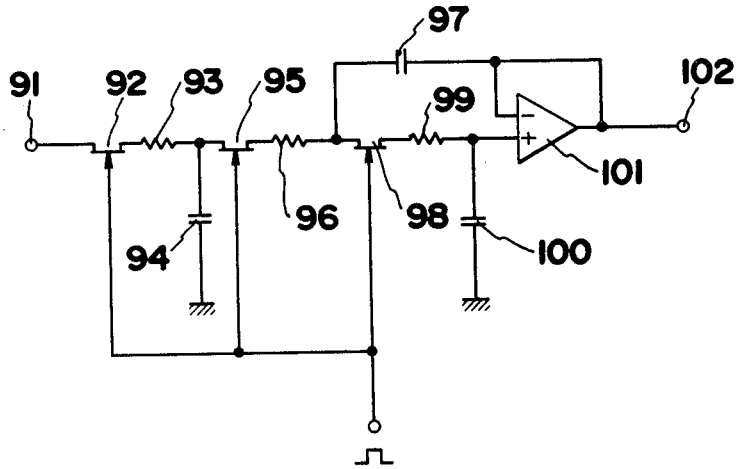
FIG. 9 is a block diagram of a triple polar active filter having an analog switch at the input terminal of each integrating circuit stage.

If one each analog switch is employed at the input terminal of each stage of two or more integrating circuits, it provides an accurate proportional relation between the cut-off frequency of the filter and the clock pulse frequency. FIG. 9 shows an example applied to a triple polar active filter. The triple polar active filter consists of three analog switches 92, 95 and 98, three resistors 93, 96 and 99, three electrostatic capacitors 94, 97 and 100 and an operational amplifier 101 arranged between an input terminal 91 and an output terminal 102.

It will now be appreciated from the foregoing description that in accordance with the present invention a satisfactory magnitude of the pass band is provided for a variable delay echo-machine which is designed to eliminate the erroneous signals and the shift pulse frequency components by employing two low pass filters with a variable cut-off frequency, particularly in cases where the frequency of the shift pulse applied to a delay element is very high, and it is possible to provide a variable echo-machine capable of producing sounds with high fidelity to the input signal. Further, it is possible to provide a variable delay echo-machine which is designed to eliminate the erroneous signals and the shift pulse frequency components by employing two low pass filters with a fixed cut-off frequency and two low pass filters with a variable cut-off frequency, which low pass filters with a variable cut-off frequency are designed based on an idea that an intermittent application of the input signal to the low pass filters causes an equivalent variation of the cut-off frequency, whereby the low pass filters with a variable cut-off frequency are simple in construction and easy to vary in cut-off frequency. An additional advantage of this invention is that it is possible to provide a low pass filter with a variable cut-off frequency which is simple in construction and easy to vary in the cut-off frequency, becuase an equivalent variation of the cut-off frequency is caused for the low pass filter by intermittent application of an input signal to each stage of the integrating circuits which determine the cut-off frequency of the low pass filter with variable cut-off frequency.

Although a limited number of preferred embodiments have been illustrated and described, it will be apparent to those skilled in the art that various changes and modifications may be made therein without departing from the spirit of the invention or from the scope of the appended claims.

What is claimed is:

1. A variable delay echo machine comprising:

a clock pulse generator for generating a clock pulse signal having a controllable frequency;

a cut-off frequency regulation pulse generator connected to said clock pulse generator for generating a rectangular wave signal having the same frequency as said clock pulse signal and havng a duty ratio directly proportional to the frequency of said clock pulse signal;

a frequency dividing signal converter connected to said cut-off frequency regulation pulse generator for generating a shift pulse signal having a frequency a predetermined integral fraction of the frequency of said rectangular wave signal;

a first variable cut-off frequency low pass filter having an input terminal, an output terminal and a cut-off frequency control terminal receiving said rectangular wave signal from said cut-off frequency regulation pulse generator for passing signals applied to said input terminal having frequencies less than a cut-off frequency proportional to the duty ratio of said rectangular pulse signal to said output terminal;

a variable time delay element having an input terminal connected to said output terminal of said first variable cut-off frequency low pass filter, an output terminal and a delay time control terminal receiving said shift pulse signal of said frequency dividing signal converter, for the coupling the signal applied to said input terminal of said variable time delay element to said output terminal of said variable time delay element after a time delay inversely proportional to the frequency of said shift pulse signal from said frequency dividing signal converter; and a second variable cut-off frequency low pass filter having an input terminal connected to said output terminal of said variable time delay element, an output terminal and a cut-off frequency control terminal receiving said rectangular wave signal from said cut-off frequency regulation pulse generator for passing signals applied to said input terminal of said second variable cut-off frequency low pass filter and having frequencies less than a cut-off frequency proportional to the duty ratio of said rectangular pulse signal to said output terminal of said second variable cut-off frequency low pass filter.

2. A variable delay echo-machine as claimed in claim 1, further comprising:

a mixing means having a first input terminal connected to said output of said first variable cut-off frequency low pass filter, a second input terminal connected to said output of said variable time delay element, and an output terminal connected to said input terminal of said variable time delay element for mixing the signals applied to said first and second input terminals and applying said mixed signals to said output terminal, of said mixing means whereby said mixing means comprises said connection between the output terminal of said first variable cut-off frequency low pass filter and said input terminal of said variable time delay element.

3. A variable delay echo-machine as claimed in either claim 1 or 2 further comprising:

a first fixed cut-off frequency low pass filter having an input terminal and having an output terminal connected to said input terminal of said first variable cut-off frequency low pass filter for passing signals applied to said input terminal of said first fixed cut-off frequency low pass filter and having frequencies less than a fixed cut-off frequency to said output terminal of said first cut-off frequency low pass filter; and a second fixed cut-off frequency low pass filter having an input terminal connected to said output terminal of said second variable cut-off frequency low pass filter and an out-put terminal for passing signals applied to said input terminal of said second fixed cut-off frequency low pass filter having frequencies less than a fixed cut-off frequency to said output terminal of said second fixed cut-off frequency low pass filter.

4. A variable delay echo-machine as claimed in either claim 1 or 2, wherein:

each of said first and second variable cut-off frequency low pass filters comprise active low pass filters having serially interconnected a first analog switching means, a first integrator means, a second analog switching means and second integrator means, said first and second analog switching means connected to said cut-off frequency regulation pulse generator for intermittently applying signals to said first and second integrator means, respectively, according to the duty cycle of said rectangular wave signal.

5. A variable delay echo-machine as claimed in either claim 1 or 2, further comprising:

a first fixed cut-off frequency low pass filter having an input terminal and an output terminal connected to said input terminal of said first variable cut-off frequency low pass filter for passing signals applied to said input terminal of said first fixed cut-off frequency low pass filter and having frequencies less than a fixed cut-off frequency to said output terminal of said first fixed cut-off frequency low pass filter;

a second fixed cut-off frequency low pass filter having an input terminal connected to said output terminal of said second variable cut-off frequency low pass filter and an output terminal for passing signals applied to said input terminal of said second filter cut-off frequency low pass filter and having frequencies less than a fixed cut-off frequency to said output terminal of said second fixed cut-off frequency low pass filter; and each of said first and second variable cut-off frequency low pass filters comprise active low pass filters having serially interconnected a first analog switching means, a first integrator means, a second analog switching means and a second integrator means, said first and second analog switching means connected to said cut-off frequency regulation pulse generator for intermittently applying an input signal to said integrator means according to the duty cycle of said rectangular wave signal.

6. A variable delay echo-machine as claimed in either claim 1 or claim 2, wherein;

said cut-off frequency regulation pulse generator comprises a means for generating a pulse having a predetermined fixed period at a predetermined fixed phase of said clock pulse signal.

7. A variable delay echo-machine as claimed in either claim 1 or 2, further comprising:

a first fixed cut-off frequency low pass filter having an input terminal and having an output terminal connected to said input terminal of said first variable cut-off frequency low pass filter for passing signals applied to said input terminal of said first fixed cut-off frequency low pass filter and having frequencies less than a fixed cut-off frequency to said output terminal of said first fixed cut-off frequency low pass filter;

a second fixed cut-off frequency low pass filter having an input terminal connected to said output terminal of said second variable cut-off frequency low pass filter and having an output terminal for passing signals applied to said input terminal of said second fixed cut-off frequency low pass filter and having frequencies less than a fixed cut-off frequency to said output terminal of said second first cut-off frequency low pass filter; and wherein said cut-off frequency regulation pulse generator comprises a means for generating a pulse having a predetermined fixed period at a predetermined fixed phase of said clock pulse signal.

8. A variable delay echo-machine as claimed in either claim 1 or 2, wherein:

each of said first and second variable cut-off frequency low pass filters comprise active low pass filters having at least one combination of an integrator means and an analog switch. ıg means connected to said integrator means and to said cut-off frequency regulation pulse generator for intermittently applying an input signal to said integrator means according to the duty ratio of said rectangular wave signal.

9. A variable delay echo-machine as claimed in either claim 1 or 2, further comprising:

a first fixed cut-off frequency low pass filter having an input terminal and having an output terminal connected to said input terminal of said first variable cut-off frequency low pass filter for passing signals applied to said input terminal of said first fixed cut-off frequency low pass filter and having frequencies less than a fixed cut-off frequency to said output terminal of said first fixed cut-off frequency low pass filter;

a second fixed cut-off frequency low pass filter having an input terminal connected to said output terminal of said second variable cut-off frequency low pass filter and an output terminal for passing signals applied to said input terminal of said second fixed cut-off frequency low pass filter; and wherein each of said first and second variable cut-off frequency low pass filters comprise active low pass filters having at least one combination of an integrator means and an analog switching means connected to said integrator means and to said cut-off frequency regulation pulse generator for intermittently applying an input signal to said integrator means according to the duty ratio of said rectangular wave signal.

* * * * *